United States Patent [19]

Arnoldi, deceased et al.

[11] Patent Number: 4,775,143

[45] Date of Patent: Oct. 4, 1988

[54] DESKEWING DEVICE FOR MAILING MACHINE

[75] Inventors: Douglas R. Arnoldi, deceased, late of Southbury; by Walter E. Arnoldi, administrator, West Hartford; John J. Stelben, Greenwich, all of Conn.

[73] Assignee: Pitney Bowes Inc., Stamford, Conn.

[21] Appl. No.: 808,198

[22] Filed: Dec. 12, 1985

[51] Int. Cl.[4] ..... B65H 9/16

[52] U.S. Cl. ..... 271/251

[58] Field of Search ..... 271/251, 184, 185, 2

[56] References Cited

U.S. PATENT DOCUMENTS

| | | | |
|---|---|---|---|
| 3,855,041 | 12/1974 | Kunisch | 271/2 X |
| 3,908,986 | 9/1975 | Bleau | 271/227 |
| 4,049,257 | 9/1977 | Church et al. | 271/9 |
| 4,266,762 | 5/1981 | Kramer et al. | 271/225 |
| 4,411,418 | 10/1983 | Pochlein | 271/236 |
| 4,428,573 | 1/1984 | Denison et al. | 271/305 |
| 4,428,667 | 1/1984 | Phelps et al. | 355/3 SH |
| 4,432,542 | 2/1984 | Clark et al. | 271/251 |
| 4,438,918 | 3/1984 | Ito et al. | 271/251 |
| 4,505,471 | 3/1985 | Stockburger | 271/251 |

*Primary Examiner*—Richard A. Schacher

*Attorney, Agent, or Firm*—Charles G. Parks, Jr.; David E. Pitchenik; Melvin J. Scolnick

[57] ABSTRACT

There is an envelope deskewing device provided with a mailing machine having a horizontal feed deck, with an elongate registration guide which extends along one side edge. Mail is fed along a feed path determined by the registration guide and a postage meter located downstream from the deskewing device. A support is mounted over the upper surface of the feed deck with a first rotary frictional drive mounted on the support for feeding the envelopes parallel to the registration guide along the feed path. A second rotary frictional drive is mounted upstream from the first rotary drive for receiving the envelopes in a random orientation ranging from parallel to the registration guide to a predetermined angle with respect to the registration guide. An abutment device mounted on the support adjacent to the second rotary drive prevents an envelope from being fed by the second rotary drive if the envelope is placed on the feed deck at an angle greater than the predetermined angle.

10 Claims, 5 Drawing Sheets

DESKEWING DEVICE FOR MAILING MACHINE

BACKGROUND OF THE INVENTION

1. Field of the Invention

The present invention relates generally to an improvement in mailing machines and more particularly to an envelope deskewing device for a mailing machine which prints postage indicia in a predetermined location on envelopes.

Mailing machines are well known in the prior art and are found in post offices and in mailrooms of companies and business offices the world over. Typically, a mailing machine comprises a feed base having an elongate deck which presents a flat surface over which envelopes can be fed one at a time, and a feeding mechanism for feeding the envelopes. Mailing machines may be either hand fed, in which case an operator places a single envelope on the feed deck and slides it into engagement with the feeding mechanism, or automotive wherein envelopes are fed seriatim from a stack held in a suitable hopper and transferred across the feed deck.

The mailing machine also includes a postage meter which, with a few exceptions is removably connected to the feed base. The postage meter, as is well known, is basically a printing device which prints a particular type of postage indicia on the envelope adjacent the upper right hand corner, the printed postage indicia serving in lieu of a postage stamp as proof of payment of the postage charge. Typically, the postage meter has settable printing wheels to facilitate selecting different amounts of postage and dates to be printed, and there are suitable mechanical or electronic means for setting the printing wheels and for keeping track of the amount of postage printed for accounting and security purposes.

The present invention is particularly useful in the hand fed type of mailing machine, but may also be utilized to advantage in automatic mailing machines. In either case, envelopes must be fed through the mailing machine in proper alignment with the printing drum of the postage meter in order to have the postage indicia printed in a precise location and orientation on the envelopes. It is important that the postage indicia be printed in a precise location and orientation in order to assure that there is no loss of any portion of the postage indicia, which would violate federal regulations covering metered mail, and also to assure that there is no loss of the customer's advertising slogan and/or design which may be printed by the meter which would offend the customer. These malfunctions are made possible by the typical mailing machine design. The postage meter is triggered by the lead edge of the envelope striking a trip actuator or energizing an electronic receiving device to signal the arrival of the envelope at a known location. If the envelope is moving through the mailing machine in a skewed relationship, the portion of the envelope which triggers the operation of the postage meter will not be in the proper location when it engages the triggering device, thereby actuating the postage meter either too soon or too late.

Another reason for the importance of feeding the envelopes through the mailing machine in proper registration with the printing drum is to avoid damage to the envelope in other portions of the mailing machine. Typically, mailing machines are provided with a moistening and sealing device upstream from the printing drum of the postage meter. If an envelope is fed through the moistening component in other than a substantially properly aligned orientation, there is a high probability that the flap of the envelope will catch and tear on the moistening component and the envelope will not be properly sealed. It is also quite possible that the tearing of the flap could cause the envelope to jam in the mailing machine and cause a complete malfunction.

After recognizing the importance of providing a deskewing device in a mail handling machine for any one or more of the reasons mentioned above, it was discovered that there is a limit to the amount of misregistration with which an envelope can be placed on the feed table and still have it become properly registered by the deskewing device before the envelope reaches the printing drum of the postage meter. It was found, in using the present invention, that an envelope would almost always be properly aligned with the normal direction of fed if it was placed on the feed deck at an angle of nor more than 10° to the normal direction of feed. Mailing machines are typically provided with a registration guide which extends along the feed deck and is parallel to the normal direction of feed of the envelope, and the maximum angle at which an envelope can be placed on the feed deck and still be properly registered by the deskewing device is called the acceptance angle, which in this case of the present invention is about 10° to 12°. While envelopes placed on the feed deck at an angle of more than 12° may be properly aligned, the probability of this is low, and is therefore not considered acceptable. Therefore, the present invention provides a device for preventing an envelope from being fed through the mailing machine which is placed on the feed deck at an angle to the registration guide which is in excess of the acceptance angle.

2. Prior Art

The present invention is a device for deskewing envelopes as they are fed into a mailing so that they will be properly aligned with a registration guide prior to passing through the postage printing device of a postage meter which forms part of the mailing machine, and includes a device for preventing envelopes from being fed which are put into the mailing machine at greater than a predetermined angle to the registration guide.

The closest prior art presently known relates primarily to document alignment devices for causing a document to be properly aligned with a registration guide before being fed into a copying machine although a few other patents relating to edge registration of documents are known. All of these patents are listed and discussed in the Information Disclosure Statement filed concurrently with this application and made a part hereof.

BRIEF SUMMARY OF THE INVENTION

The present invention is intended to obviate or eliminate the disadvantages and problems discussed above in connection with known mailing machines.

In its broader aspects, the present invention is utilized in a mailing machine having a substantially horizontal envelope feed deck, an elongate registration guide extending along one side edge of the feed deck, a driven rotary frictional drive element mounted beneath the feed deck and protruding upwardly through an opening therein, and a postage meter mounted on the feed deck in a downstream direction from the rotary frictional drive element in position to print postage indicia in a predetermined location on an envelope being fed along the feed deck. The envelope deskewing device comprises a support means mounted over an upper surface of the feed deck, a first rotary frictional drive means mounted on the support means for feeding envelopes along the feed deck in a direction parallel to the registration guide with an edge of the envelopes abutting the registration guide, and a second rotary frictional drive means mounted on the support means and the feed deck upstream from the first rotary frictional drive means for receiving envelopes placed on the feed deck in a random orientation ranging from parallel to the registration guide to a predetermined maximum angle with respect thereto, and for feed envelopes so placed on the feed deck toward the registration guide, thereby aligning the envelopes with the registration guide. The device is also provided with means for driving the first and second rotary frictional drive means in synchronism from the driven rotary frictional drive element. All abutment means is mounted on the support means adjacent the second rotary frictional drive means in position to prevent an envelope from being fed by the second rotary frictional drive means if the envelope is placed on the upper surface of the feed deck at an angle to the registration guide which is in excess of the predetermined angle.

In its preferred embodiment, the first rotary frictional drive element comprises a first feed roller rotatably mounted over the driven rotary frictional drive element and is driven thereby. The second rotary frictional drive means comprises a second feed roller driven in synchronism with the first feed roller and mounted with its axis at an angle to the registration guide, and a freely rotatable ball mounted in the feed deck in driving engagement with the second feed roller. The abutment means comprises a generally wedge shaped block pivotally to the support means, the block having a lower surface disposed at an angle to the upper surface of the feed deck which forms a camming surface by which an envelope raises the block to pass thereunder toward the registration guide if the envelope is placed on the feed deck at an angle to the registration guide which is equal to or less than the predetermined angle. The block is also provided with a side surface which is disposed at the predetermined angle with respect to the registration guide so that an envelope which is placed on the feed deck at an angle in excess of the predetermined angle strikes the side surface and is unable to reach the lower camming surface, thereby preventing the envelope from being fed into the mailing.

Objects and advantageous features of the present invention will be more readily apparent from an understanding of the following detailed description of a presently preferred embodiment of the invention when considered in conjunction with the accompanying drawings in which.

DETAILED DESCRIPTION OF THE INVENTION

Figure 1:
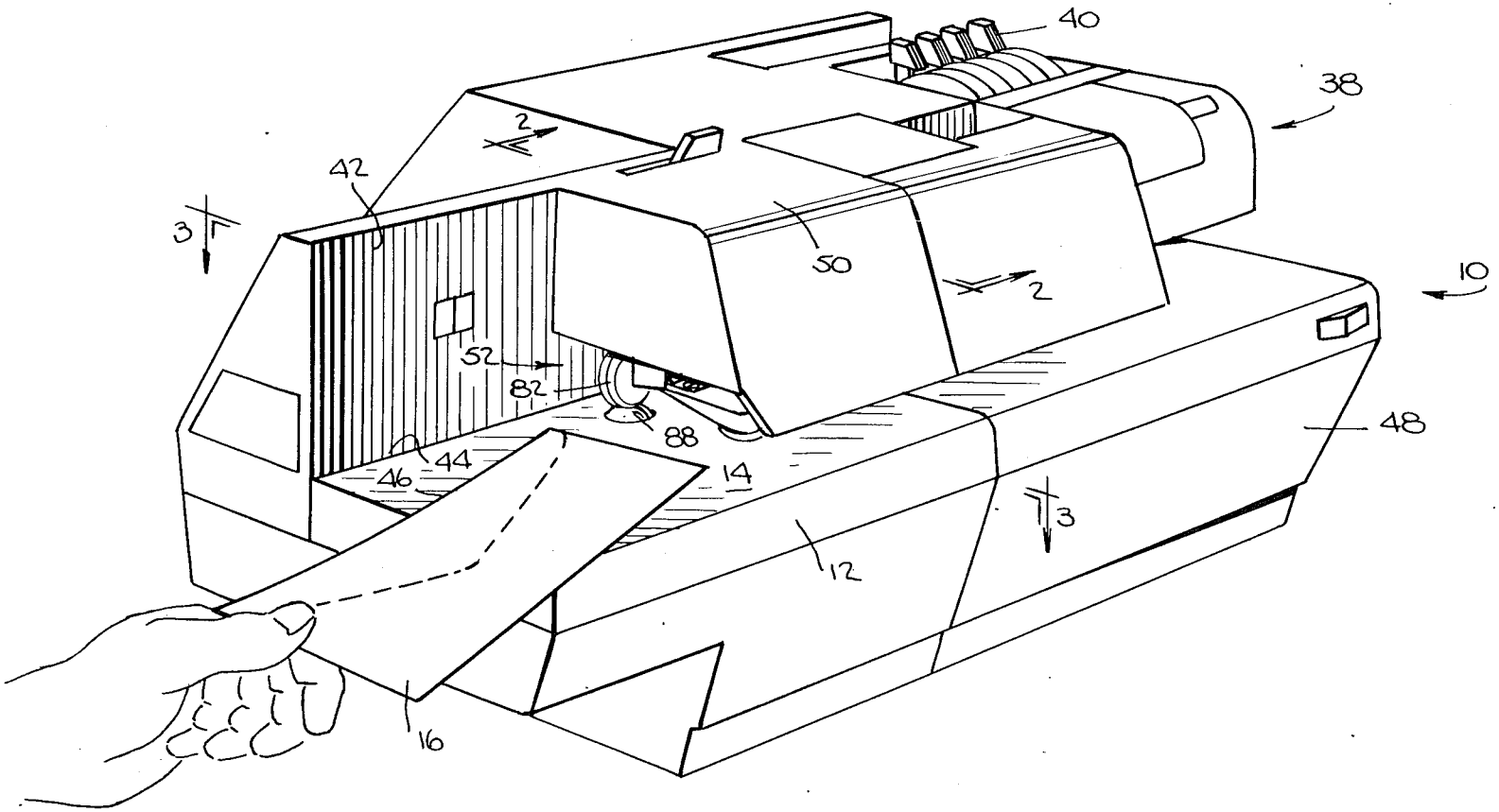
FIG. 1 is an isometric view of a typical mailing machine embodying the present invention and showing an envelope being placed on the feed deck of the mailing machine.
Figure 2:
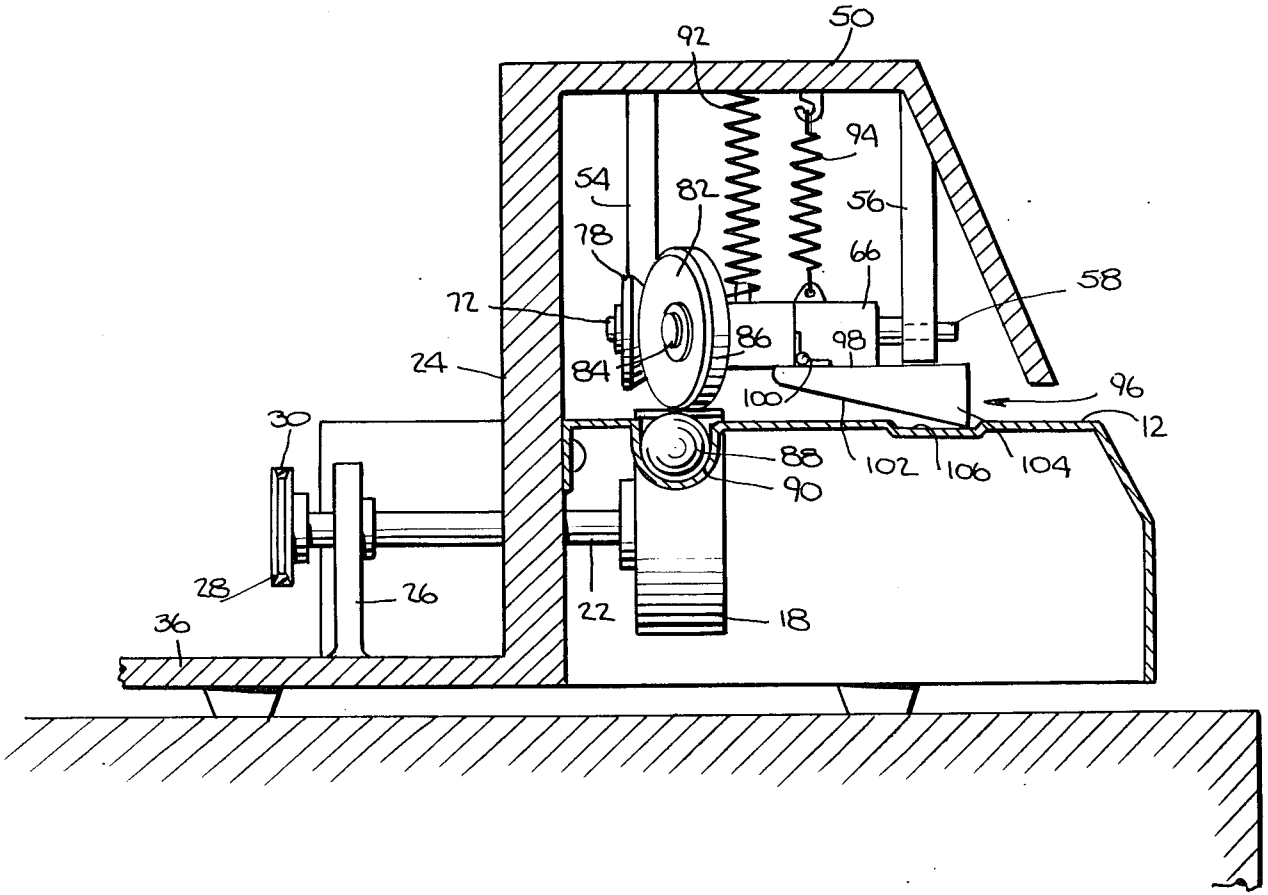
FIG. 2 is a vertical sectional view taken on the line 2—2 of FIG. 1.
Figure 3:
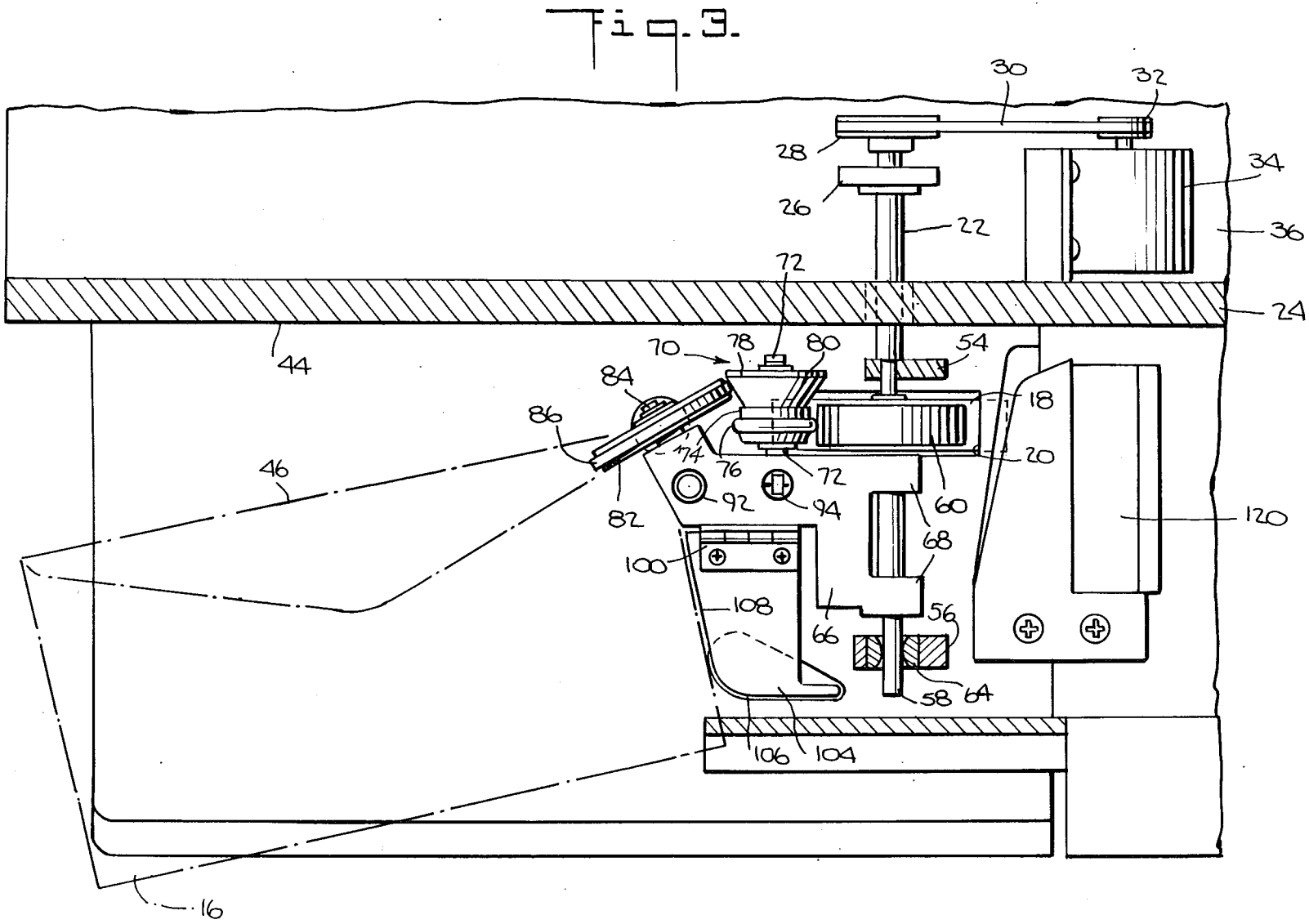
FIG. 3 is a horizontal sectional view taken on the line 3—3 of FIG. 1.
Figure 4:
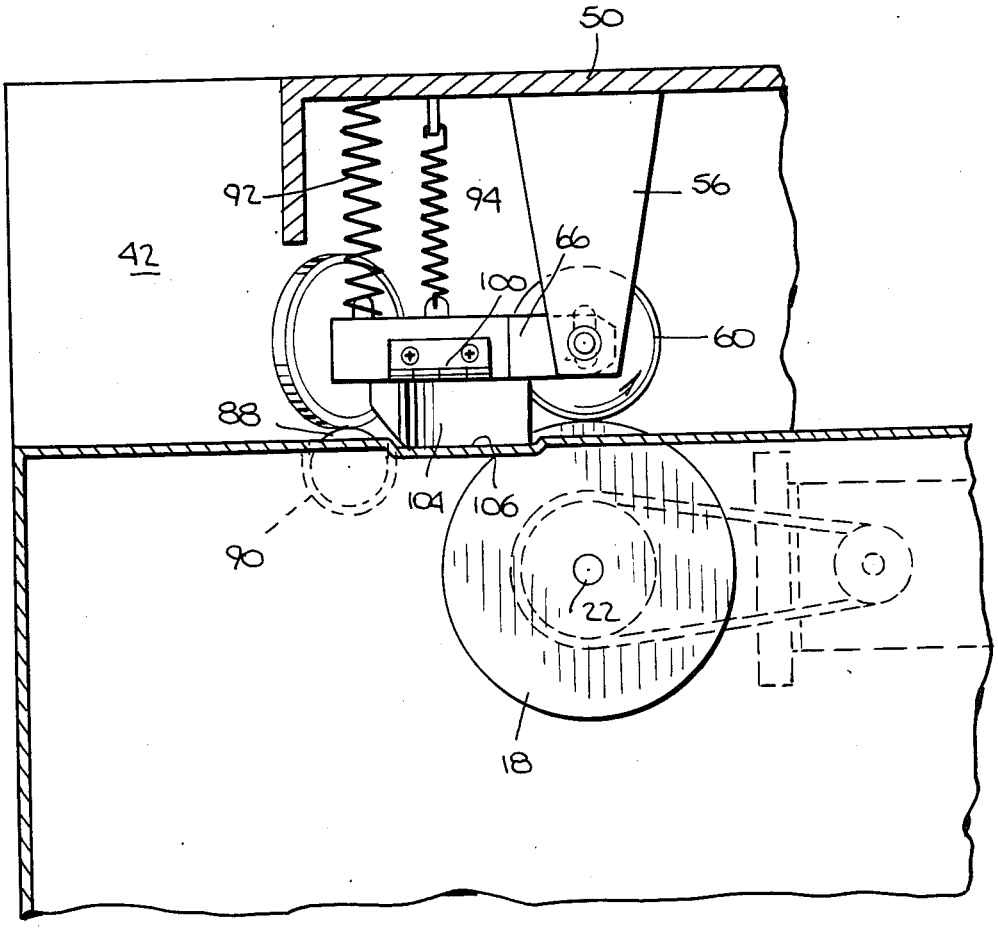
FIG. 4 is a partial front view of the feeding and abutment assembly of the present invention.

Referring now to the drawings, and more particularly to FIG. 1 thereof, there is shown a mailing machine generally designated by the reference numeral 10 in which the present invention is embodied and which is an improvement over prior known mailing machines. The mailing machine 10 comprises an elongate feed deck 12 usually extending from one end of the machine to the other, the feed deck having an upper surface 14 along which envelopes 16 are adapted to be fed. As seen in FIGS. 2, 3 and 4, the mailing machine also comprises a driven rotary frictional drive element, particularly the feed roller 18 mounted beneath the feed deck 12 and projecting upwardly through a suitable elongate opening 20 formed in the feed deck 12. The feed roller 18 is mounted on a shaft 22 rotatably mounted in a wall 24 and an adjacent parallel wall 26, and is driven through a pulley 28 driven by a belt 30 which is driven by a pulley 32 mounted on the output shaft of a motor 34 suitably mounted on a portion of the mailing machine base 36.

The mailing machine also comprises a postage meter generally designated by the reference numeral 38 and is located adjacent the downstream end of the feed deck 12 beyond the feed roller 18 in the direction of movement of the envelopes 16. The postage meter 38 is very well known in the art and includes a rotatable printing drum which carries printing a distinctive postage indicia in a predetermined location on envelopes passing under the printing drum typically in the upper right hand corner of the envelope. The printing drum has settable printing wheels by which the amount of postage printed and the date can be changed at will. A plurality of levers 40 project from the postage meter by which the printing wheels for the amount of postage are set. Other details of the construction and operation of the postage meter are not part of the present invention and are therefore omitted from this description.

The mailing machine 10 also includes an upstanding rear wall 42 the lower edge 44 of which constitutes a registration guide along which the upper longitudinal edge 46 of the envelope 16 must ride in order for the envelope 16 to be properly positioned when it passes under the printing drum of the postage meter 38. If the envelope 16 is not traveling parallel to the registration guide 44 when the postage indicia is printed thereon the indicia will be misaligned and possibly improperly printed on the envelope.

The mailing machine 10 further includes a base housing 48 and another housing 50 which contains a portion of the feed deck 12 for a purpose to be hereinafter made clear.

As seen in FIG. 1, the mailing machine 10 is of the single feed or hand fed type that is, envelopes are manually placed one by one on the upper portion 14 of the feed deck 12 and are pushed into the feeding mechanism of the mailing machine. There is no automatic feeding device by which a stack of envelopes are automatically fed one after another into the mailing machine. In typical practice, when envelopes are manually placed on the feed deck, they are skewed at an angle to the longitudinal axis of the feed deck 12 and similarly skewed to the registration guide 44, unless the operator exercises great care in placing the envelope on the feed deck. Even with the registration guide 44, a certain amount of time and effort are required by the operator to assure that the upper edge 46 of each envelope 16 placed on the feed deck 12 is in contact with the registration guide 44 and remains in contact therewith while the envelope is being pushed into engagement with the feeding mechanism of the mailing machine. Obviously this greatly diminishes the rate at.which envelopes can be fed through the mailing machine and thereby decreases the capacity of the machine. To overcome this drawback, the present invention comprises a deskewing device built into the mailing which receives envelopes placed on the feed deck 12 in a random orientation ranging from parallel with the registration guide 44 to a predetermined maximum angle with respect thereto and which feeds an envelope placed in the feed deck in an orientation other than parallel with the registration guide 44 toward the registration guide 44 so as to change the direction of feed of such envelope to parallel with the registration 44, thereby assuring that the envelope will be properly aligned with the feed deck and the printing drum of the postage meter when the envelope passes thereunder.

Figure 5:
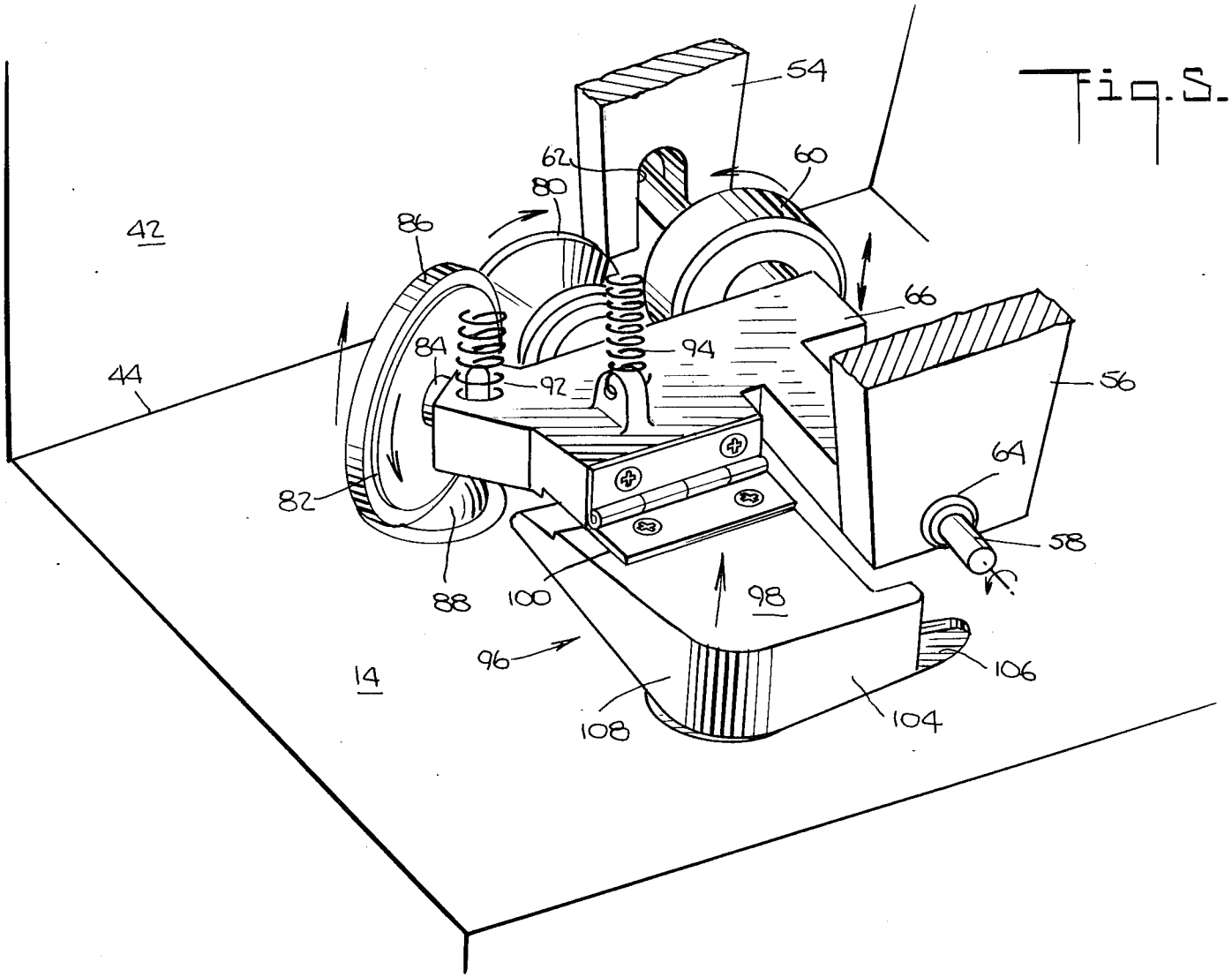
FIG. 5 is an isometric view of the assembly shown in FIG. 4 and drawn to an enlarged scale.

The envelope deskewing device, generally designated by the numeral 52 in FIG. 1, is mounted on a portion of the housing 50 in overlying relationship with the feed deck 12, the details of the deskewing device best appearing in FIGS. 2–5. As best seen in FIGS. 2 and 5, a pair of spaced parallel walls 54 and 56 depend from the upper wall of the housing 50 and support a shaft 58. A first rotary frictional drive means in the form ofa feed roller 60 is rotatably mounted on the shaft 58 in position to normally engage the feed roller 18 mounted beneath the feed deck 12 and projecting through the opening 20. As best seen in FIG. 5, the wall 54 is provided with a vertical slot 62 which permits a limited amount of up and down movement of the end of the shaft 58 which projects through the slot 62 which in turn permits the feed roller 60 to slightly separate from the roller 18 to accommodate envelopes of varying thickness. The other end of the shaft 58 pivots about a spherical bearing 64 in response to the feeding of envelopes of different thickness.

An elongate support block 66 is rotatably mounted on the shaft 58 by means of a pair of legs 68, and extends in an upstream direction sufficiently to support two other rollers. An intermediate drive roller generally designated by the reference numeral 70 is rotatably mounted on the support block by means of a stub shaft 72 and comprises a generally cylindrical body member 74 which carries a first driving surface in the form of a tire portion 76 which is in frictional driving engagement with the feed roller 60 and is driven thereby. The drive roller 70 also has a second driving surface in the form of a conical shaped portion 78 which provides a flat driving surface 80 the purpose of which will be made clear hereinbelow.

A second rotary frictional drive means in the form of a feed roller 82 is rotatably mounted on the upstream end of the support block 66 by means of a stub shaft 84, the roller 82 having a tire 86 which is in driving engagement with the driving surface 80 of the roller 70. It will be apparent that the axis of the roller 82 is disposed at the same angle to the registration guide 44 as the conical shaped portion 78 of the driving surface 80 which angle is about 10°. As best seen in FIGS. 3 and 4, an idler ball 88 is carried in a depression 90 forward in the feed deck 12 on which the feed roller 82 rests, the roller 82 and ball 90 constituting part of a rotary frictional drive means carried by the support block 66 and the feed deck 12, the roller 60 and the intermediate drive roller being the other part of the rotary frictional drive means. As can best be seen from FIG. 3, the envelope 16 which is placed on the upper surface of the feed deck 12 and which is not in contact with the registration guide will be fed toward the registration guide 44 by the feed roller 82 and ball 90.

In order to provide a proper and uniform feed pressure between the roller 82 and the ball 90, the support block is urged downwardly by a compression spring 92 which is captured between the upper surface of the block 66 and the undersurface of the housing 50. Simultaneously, a tension spring 94 is engaged between the upper surface of the support block 66 and the undersurface of the housing 50 and pulls up on the support block 66. The downward force exerted on the support block 66 by the compression spring 92 is considerably larger than the upward force exerted by the tension spring 94, the latter being only to equalize the driving force of the roller 82 and ball 90 on envelopes of varying thickness.

The deskewing device is provided with an abutment means mounted on the support block adjacent the rotary frictional drive means in position to prevent an envelope from being fed by the roller 82 and ball 90 if the envelope is placed on the feed deck at an angle to the registration guide 44 which is in excess of the maximum angle (10°) from which the device is capable of aligning an envelope with the registration guide before the envelope reaches the rollers 60 and 18. The abutment means is in the form of a wedge shaped block generally designated by the numeral 96 and best seen in FIGS. 2 and 5. The block 96 has a generally horizontal flat upper surface 98 which is suitably secured to a hinge 100 which in turn is suitably secured to a side wall of the support block 66. Thus the entire wedge shaped block 96 can pivot upwardly about the hinge 100.

The lower surface 102 of the block 96 is disposed at an angle to the upper surface 14 of the feed deck 12, with the thinnest portion of the block 96 being adjacent the hinge 100. The block 96 is generally rectangular when viewed in plan, and the thick end 104 is seen to rest in an elongate depression 106 formed in the feed 12. Also, the side wall 108 of the block 96 is disposed at an angle to the registration guide 44 which is approximately one-half of the angle at which the axis of the feed roller 82 is disposed to the registration guide. The angle of the side wall 108 is in effect the predetermined maximum angle at which an envelope can be placed on the feed deck and still be fed by the roller 82 and ball 90.

DESCRIPTION OF OPERATION

Referring back to FIG. 1, the envelope 16 is positioned such that its leading end is nearly abutting the envelope deskewing device 52. When the operator continues to forwardly position the envelope 16, the deskewing device 52 will accept the envelope 16 and register it for proper printing of the metered stamp. It the angle between the top of the envelope 16 and the registration guide 44 is 10° or less, the deskewing device 52 will automatically begin to cause the envelope 16 to turn in a clockwise direction until the top of the envelope 16 registers with the guide 44. The nip between the roller 82, and the idler ball 88 continuously urges the envelope 16 downstream, while simultaneously being resisted by the lower surface 102 of the block 96.

The envelope 16 is drawn along the feed path, and the block 96 is pivoted upwards while continuing to bear upon the upper surface of the envelope 16. The normal force at the conveying nip between the roller 82, and the ball 88 is sufficient to urge and deskew the heaviest mail piece acceptable for printing at the postage meter 38. While the envelope 16 continues moving along under urging by the roller 82, the fed roller 60 also assists in advancing the envelope, and accordingly, at this point, an envelope flap moistening device 120 (see FIG. 3) will prepare the envelope flap for sealing by a downstream located (not shown) sealing device, prior to being printed by the postage meter 38.

In the event that the operator positions the envelope 16 (see FIG. 1) at an angle greater than 10° as measured between the top of the envelope 46, and the guide 44, the thick end 104 of the block 96 effectively blocks entrance of the envelope to the machine 10 at any other angle than 10° or less as previously discussed. The depression 106 and the end 104 cooperate to positively prevent acceptance of the envelopes 16 until the envelope 16 is properly positioned. It is possible of course, for the operator to forceably lift the block 96, and thereby push the envelope 16 into engagement with the deskewing device 52, however, this will cause the undesired result the invention has been designed to prevent.

Therefore, having described in detail, the deskewing device for a mailing machine, the advantages of which will be apparent, it will be recognized that modifications to the enclosed drawings or changesmade to parts described in the foregoing specification will not in any way alter the spirit and scope of the appended claims.

What is claimed is:

1. In a mailing machine having a substantially horizontal envelope feed deck, an elongated registration guide extending along one side edge of said feed deck, a driven rotary frictional drive element mounted beneath said feed deck and projecting upwardly through an opening therein, and a postage meter mounted on said feed deck in a downstream direction from said rotary frictional drive element in position to print postage indicia in a predetermined location on envelopes being fed along said predetermined location, an envelope deskewing device comprising:

A. support means mounted over an upper surface of said feed deck,

B. first rotary frictional drive means mounted on said support means for feeding envelopes along said feed deck in a direction parallel to said registration guide with an edge of the said the envelopes abutting said registration guide, said first rotary frictional drive means including a first feed roller rotatably mounted on said support means overlying said rotary frictional drive element and in driving engagement therewith, C. second rotary frictional drive means mounted on said support means and said feed deck upstream from said first rotary frictional drive means for receiving envelopes placed on said feed deck in a random orientation ranging from parallel to said registration guide to a predetermined maximum angle with respect thereto, and for feeding envelopes so placed on said feed deck toward the said registration guide, thereby aligning said envelopes with said registration guide, said second rotary frictional drive means including a second feed roller rotatably mounted on said support means upstream from said first feed roller with the axis of said second feed roller disposed at an angle to said registration guide, and a rotary element mounted in said feed deck in driving engagement with said second feed roller, D. means for driving said first and second rotary frictional drive means in synchronism from said driven rotary frictional drive element, said means including an intermediate drive roller mounted on said support means between said first and second feed rollers, said intermediate drive roller having a first driving surface disposed generally parallel to the axis of said intermediate drive and in driving engagement with the peripheral surface of said first feed roller and a second driving surface disposed at an angle to the axis of said intermediate drive roller and in driving engagement with the peripheral surface of said second feed roller.

2. A deskewing device as set forth in claim 1 further comprising abutment means mounted on said support means adjacent said second rotary frictional drive means in position to prevent an envelope from being fed by said second rotary frictional drive means if the envelope is placed on said upper surface of said feed deck at an angle to said registration guide which is in excess of said predetermined angle, whereby envelopes fed by said first rotary frictional drive means to said postage meter are properly aligned parallel to said registration guide and in contact with it so that said postage meter prints the postage indicia in the predetermined location on the envelope.

3. A deskewing device as set forth in claim 2 wherein said abutment means comprises a generally wedge shaped block having a thinner lower end, said block being pivotally connected adjacent the thinner end thereof to said support means, said block having a lower surface disposed at an angle to said upper surface of said feed deck which forms a camming surface by which an envelope raises said block to pass thereunder toward said registration guide if said envelope is placed on said feed deck at an angle to said registration guide which is equal to or less than said predetermined angle.

4. A deskewing device as set forth in claim 3 wherein said wedge shaped block further includes a side surface which is disposed at said predetermined angle with respect to said registration guide so that an envelope which is placed on said feed deck at an angle in excess of said predetermined angle strikes said side surface and is unable to reach said lower surface, thereby preventing said envelope from being fed into the mailing machine.

5. In a mailing machine having a substantially horizontal envelope feed deck, an elongated registration guide extending along one side edge of said feed deck, a driven rotary frictional drive element mounted beneath said feed deck and projecting upwardly through an opening therein, and a postage meter mounted on said feed deck in a downstream direction from said rotary frictional drive element in position to print postage indicia in a predetermined location on envelopes being fed along said predetermined location, an envelope deskewing device comprising:

A. support means mounted over an upper surface of said feed deck,

B. first rotary frictional drive means mounted on said support means for feeding envelopes along said feed deck in a direction parallel to said registration guide with an edge of the envelopes abutting said registration guide, C. second rotary frictional drive means mounted on said support means and said feed deck upstream from said first rotary frictional drive means for receiving envelopes placed on said feed deck in a random orientation ranging from parallel to said registration guide to a predetermined maximum angle with respect thereto, and for feeding envelopes so placed on said feed deck toward said registration guide, thereby aligning said envelopes with said registration guide, D. means for driving said first and second rotary frictional drive means in synchronism from said driven rotary frictional drive element, and E. abutment means mounted on seid support means adjacent said second rotary frictional drive means in position to prevent an envelope from being fed by said second rotary frictional drive means if the envelope is placed on said upper surface of said feed deck at an angle to said registration guide which is in excess of said predetermined angle, said abutment means including a generally wedge shaped block having a thinner lower end, said block being pivotally connected adjacent the thinner end thereof to said support means, said block having a lower surface disposed at an angle to said upper surface of said feed deck which forms a camming surface by which an envelope raises said block to pass thereunder toward said registration guide if said envelope is placed on said feed deck at an angle to said registration guide which is equal to or less than said predetermined angle, thereby envelopes fed by said first rotary frictional drive means to said postage meter are properly aligned parallel to said registration guide and in contact with it so that said postage meter prints the postage indicia in the predetermined location on the envelope.

6. A deskewing device as set forth in claim 5 wherein said wedge shaped block further includes a side surface which is disposed at said predetermined angle with respect to said registration guide so that an envelope which is placed on said feed deck at an angle in excess of said predetermined angle strikes said side surface and is unable to reach said lower surface, thereby preventing said envelope from being fed into the mailing machine.

7. A deskewing device as set forth in claim 5 wherein said first rotary frictional drive means comprises a first feed roller rotatably mounted on said support means overlying said rotary frictional drive element and in driving engagement therewith.

8. A deskewing device as set forth in claim 7 wherein said second rotary frictional drive means comprises a second feed roller rotatably mounted on said support means upstream from said first feed roller with the axis of said second feed roller disposed at an angle to said registration guide, and a rotary element mounted in said feed deck in driving engagement with said second feed roller.

9. A deskewing device as set forth in claim 8 wherein said means for driving said first and second rotary frictional drive means in synchronism comprises an intermediate drive roller mounted on said support means between said first and second feed rollers, said intermediate drive roller having a first driving surface disposed generally parallel to the axis of said intermediate drive and in driving engagement with the peripheral surface of said first feed roller and a second driving surface disposed at an angle to the axis of said intermediate drive roller and in driving engagement with the peripheral surface of said second feed roller.

10. A deskewing device as set forth in claim 9 wherein said wedge shaped block further includes a side surface which is disposed at a suitable angle relative to said registration guide so that an envelope which is placed on said feed deck at an angle in excess of said predetermined angle strikes said side surface and is unable to reach said lower surface, thereby preventing said envelope from being fed into the mailing machine.

* * * * *